US005263340A

United States Patent [19]

Sekoguchi et al.

[11] Patent Number: 5,263,340

[45] Date of Patent: Nov. 23, 1993

[54] ABSORPTION GENERATOR

[75] Inventors: Kotohiko Sekoguchi, Ikeda; Masahiro Furukawa, Ohra, both of Japan

[73] Assignee: Sanyo Electric Co., Ltd., Osaka, Japan

[21] Appl. No.: 872,713

[22] Filed: Apr. 21, 1992

[30] Foreign Application Priority Data

Apr. 23, 1991 [JP] Japan ..... 3-117850

[51] Int. Cl.[5] ..... F25B 33/00

[52] U.S. Cl. ..... 62/497; 62/476

[58] Field of Search ..... 62/101, 476, 497; 165/159, 161, 111, 114; 122/461, 483.1, 483.2, 483.3

[56] References Cited

U.S. PATENT DOCUMENTS

| | | | |
|---|---|---|---|
| 1,399,035 | 12/1921 | Thayer . | |
| 2,398,279 | 4/1946 | Barnebey | 122/51 |
| 2,499,302 | 2/1950 | Emhardt | 159/28 |
| 4,049,664 | 8/1936 | Rinaman | 62/5 |
| 4,183,228 | 1/1980 | Saito et al. | 62/497 |
| 4,487,036 | 12/1984 | Itoh et al. | 62/476 X |
| 4,570,456 | 2/1986 | Reimann et al. | 62/497 X |
| 4,580,407 | 4/1986 | Aime et al. | 62/148 |

FOREIGN PATENT DOCUMENTS

| | | |
|---|---|---|
| 0110763 | 11/1983 | European Pat. Off. . |
| 36549 | 3/1885 | Fed. Rep. of Germany . |
| 1776089 | 9/1971 | Fed. Rep. of Germany . |
| 512657 | 9/1939 | United Kingdom . |

*Primary Examiner*—John M. Sollecito
*Attorney, Agent, or Firm*—Darby & Darby

[57] ABSTRACT

A generator for an absorption refrigerator has heat transfer pipes within a shell main body, an absorbing solution injecting port and absorbing solution exhausting port. An absorbing solution exhausting port is provided which receives the absorbing solution flowing over a dam which is higher than the exhaust port on the absorbing solution injecting port side. A steam box is provided to cooperate with the absorbing solution exhausting port, which box has an opening above the top of the dam. The absorbing solution flowing in the main body injected from the injecting port (3) forms a closed type heat exchanger connected with an open type heat exchanger provided at the steam box into which the absorbing solution vaporizes as it flows over the dam (41) into the exhaust box (42).

8 Claims, 4 Drawing Sheets

ABSORPTION GENERATOR

BACKGROUND OF THE INVENTION

1. Field of the Invention

This invention is related to a generator for absorption refrigerators in which, for instance, water is used as a refrigerant and a salt solution such as lithium bromide is used as an absorbing solution.

2. Description of the Prior Art

As a generator of this type, for instance, that disclosed in the Japanese Patent Application Laid-Open No. 243670/1988 official gazette is known.

The generator proposed herein is constructed such that a group of heat transfer pipes which can transmit high temperature steam are placed in the lower portion within the shell main body. A space (steam chamber) for generating refrigerant vapor is provided above the absorbing solution which is injected so as to enable the heat transfer pipes to be dipped, and an eliminator is further provided in the shell upper portion to isolate the absorbing solution accompanying the refrigerant vapor.

A generator of the above construction is a so-called open type heat exchanger which has a space for the refrigerant to freely vaporize, and the heating and concentrating of the absorbing solution is by means of pool boiling.

There are two stages in a heat transfer process in which an absorbing solution is heated by heat transfer pipes in a generator. The first one is convective heat transfer which occurs when the degree of subcooling is decreased because of a subcool state in which the absorbing solution supplied to the generator is lower than the saturation temperature, and it is further increased to a temperature required for causing a phase change. The second stage is heat transfer involving a phase change, which occurs when the absorbing solution overheated by the convective heat transfer of the first stage is boiled or the surface vaporization at the level takes place.

In the above-mentioned conventional generator, since the absorbing solution has a free level throughout the generator, the absorbing solution, after having entered the generator, flows at an extremely low speed, and thus the convective heat transfer portion inherently has low heat transfer characteristics corresponding to free convective heat transfer. That is, even if the absorbing solution is injected into the generator using a pump or the like, the pressure at the time of injection is opened to the free level and does not directly act as a pressure fluidizing the absorbing solution, so that the fluidizing speed of the absorbing solution becomes very low and heat exchange cannot fully be performed at the surface of the heat transfer pipes.

SUMMARY OF THE INVENTION

Accordingly, even if it is designed so that the portion of heat transfer with boiling which is another heat transfer mode at the outer surface of heat transfer pipes, and heat transfer on the inner surface of the heat transfer pipes, that is, heat transfer with condensation or heat transfer by forced convection of hot water have high heat transfer coefficients, the total heat transfer characteristics of the generator including the above-mentioned convective heat transfer would be remarkably degraded. This resulted in inconveniences such as insufficient concentration by heating of the absorbing solution in the generator and need for a large heat transfer area, and the solution of this has been desired.

This invention has been accomplished to solve the above described problem of the prior art. It is formed using the principles of both a closed type heat exchanger and an open type heat exchanger. A closed type heat exchanger is one that is always filled with absorbing solution. In the closed type heat exchanger, the absorbing solution flows while maintaining its pressure or without vaporizing by heating because there is no space for releasing the pressure or vaporizing. An open type heat exchanger has a space above the surface of the absorbing solution flowing into the exchanger. This space may be filed with the vaporized absorbing solution. Depending on the dimensions of the space, the pressure of the absorbing solution is released and the absorbing solution, which flows from the closed type heat exchanger and is heated, can vaporize into the space.

The invention includes a generator in which heat transfer pipes for transmitting a heat source fluid, such as high temperature steam, are disposed in a shell. A port for exhausting an absorbing solution is provided in the shell at the heat source inflow side, and a port for injecting the absorbing solution is provided in the shell at the heat source outflow side. The absorbing solution injecting port side is formed into a closed type heat exchanger, and the absorbing solution exhausting port side is formed into an open type heat exchanger. Baffles are provided at a small pitch in the closed type heat exchanger and at a large pitch in the open type heat exchanger. Also, the absorbing solution injecting port is provided at a position higher than a dam in the shell at the absorbing solution exhausting port of the open type heat exchanger.

Since, in the closed type heat exchanger portion at the absorbing solution injecting port side, there is no escape for the pump pressure used for injecting the absorbing solution, the pump pressure at the time of injecting the absorbing solution also directly acts on the absorbing solution in the closed type heat exchanger, and the absorbing solution is pressed toward the absorbing solution exhausting port with a strong force. For this, even if baffles are mounted in zigzag fashion at a small pitch in the closed type heat exchanger at the absorbing solution injecting port side, the absorbing solution travels relatively fast toward the absorbing solution exhausting port. Thus, the amount of heat exchange with the heat source increases through the heat transfer pipes, and the absorbing solution is overheated until it reaches the open type heat exchanger at the absorbing solution exhausting port side and generates substantial refrigerant vapor at the open type heat exchanger. The generated refrigerant vapor is exhausted via the steam box, and the absorbing solution, the concentration of which has been increased by isolation of the refrigerant vapor, is exhausted from the absorbing solution exhausting port.

DESCRIPTION OF THE PREFERRED EMBODIMENTS

Figure 1:
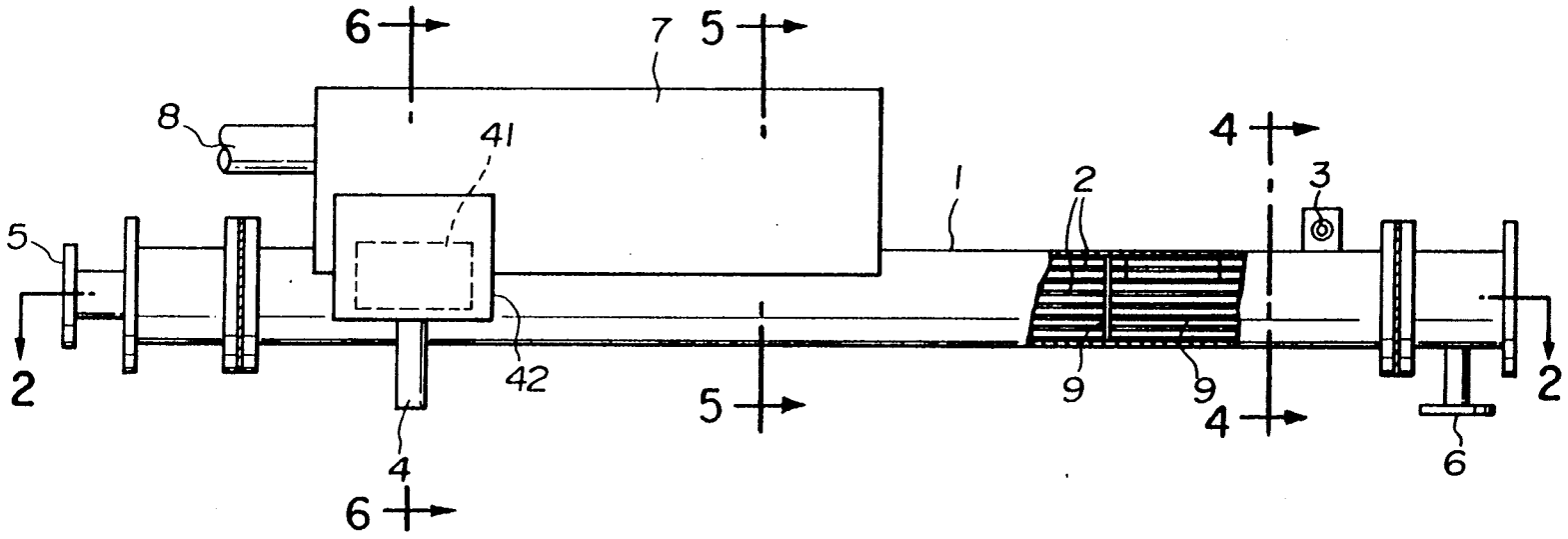
FIG. 1 is a partly broken explanatory view as seen from the front.
Figure 2:
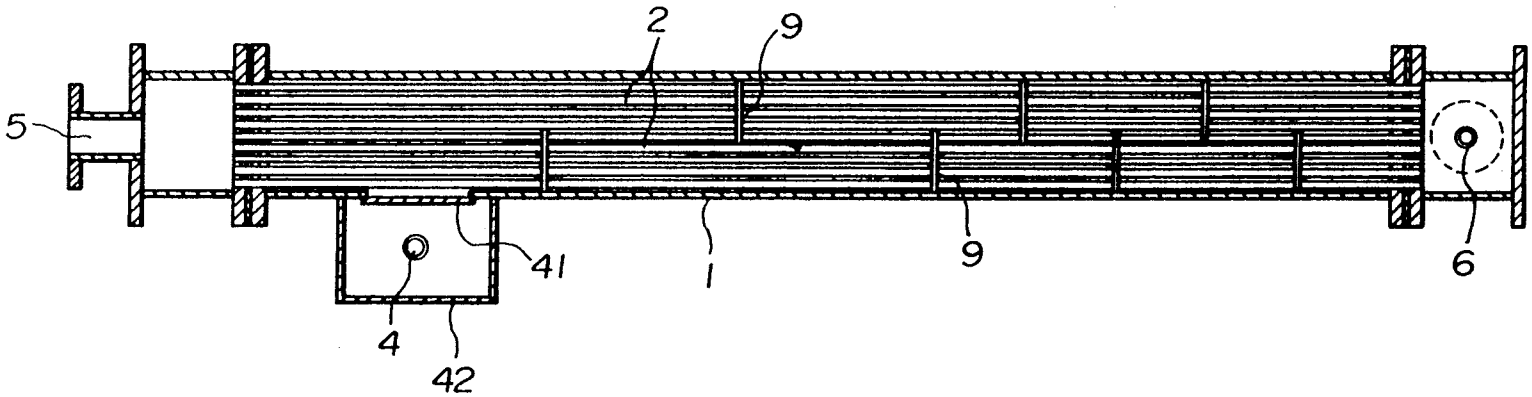
FIG. 2 is a sectional explanatory view along line 2—2 of FIG. 1.

This invention is now described according to the drawings. In FIGS. 1 and 2, 1 is a shell main body having heat transfer pipes 2 within. There is a port 3 for injecting an absorbing solution and a port 4 for exhausting the absorbing solution. Reference numeral 5 indicates a heat source inlet port, while 6 is a heat source outlet port. There is also a steam box 7 for refrigerant, a port 8 for exhausting the refrigerant vapor and baffles 9. An absorbing solution pump (not shown) is connected to the absorbing solution injecting port 3 through piping.

Shell main body 1 is a tubular body in which a large number of heat transfer pipes 2 are disposed in parallel in the longitudinal direction. The heat transfer pipes are respectively mounted so that a heat source such as high temperature vapor or hot water is received from heat source inlet port 5 provided in a header at the lefthand side of the drawing. The heated fluid passes through the pipes 2 inside the shell 1 and is exhausted from heat source outlet port 6 provided in a header at the right-hand side of the drawing.

Absorbing solution injecting port 3 is provided in shell main body at the heat source outlet port 6 side, and the absorbing solution exhausting port 4 is provided at the heat source inlet port 5 side. Absorbing solution injecting port 3 is located in the upper portion of shell main body 1, and absorbing solution exhaust port 4 is located in the bottom of exhaust box 42 located on a side of shell main body 1 which has a dam 41. The height of dam 41 is adjusted so that it is higher than the top of the inner wall of shell main body 1 at the absorbing solution injecting port 3 side. In addition, absorbing solution injecting port 3 is provided at a position higher than dam 41.

Figure 6:
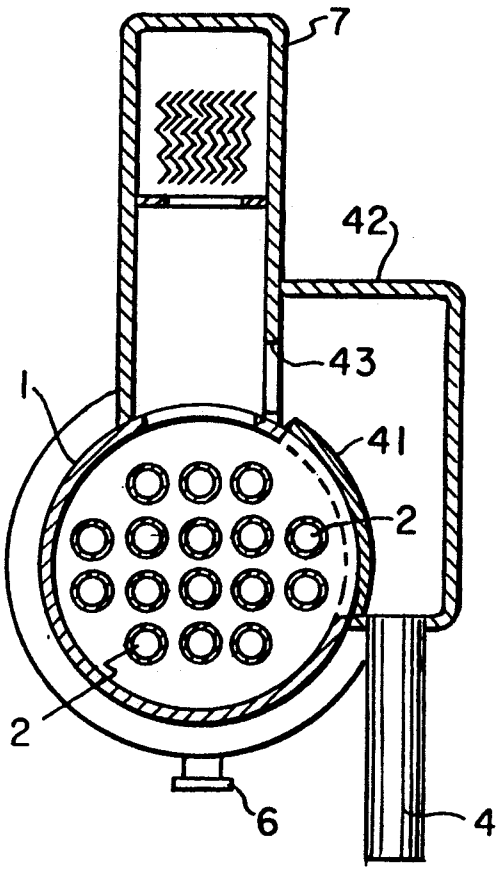
FIGS. 4, 5 and 6 are cross-sections taken along lines 4—4, 5—5 and 6—6, respectively, in FIG. 1.
Figure 5:
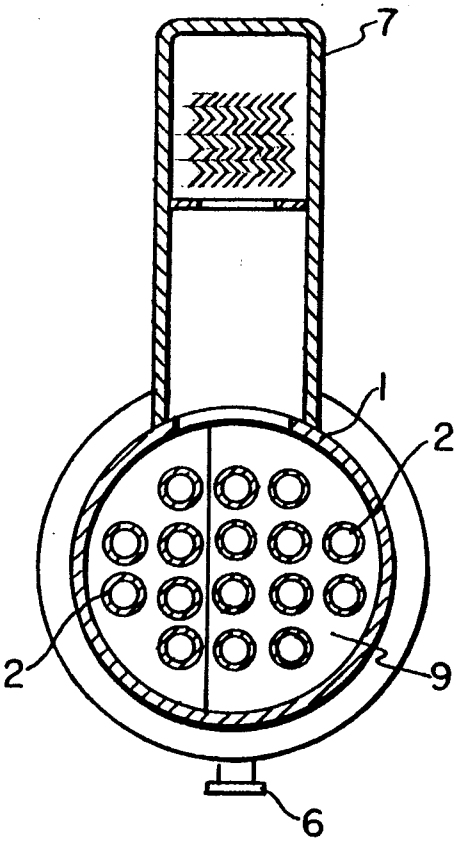
Figure 4:
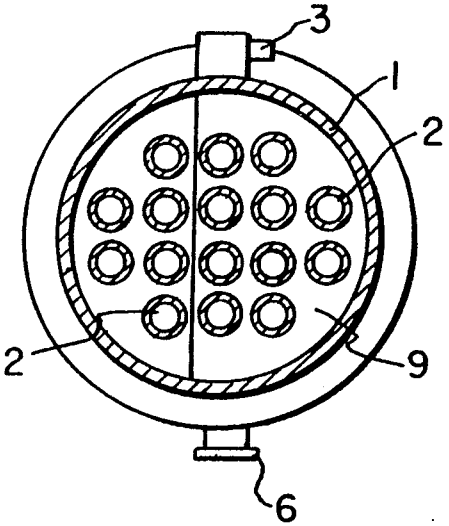

Further, as shown in FIGS. 5 and 6, steam box 7 is mounted on the upper portion of the shell main body 1 and there is a space in the shell to provide communication with shell main body 1 interior in the upper portion of shell main body 1 at the heat source inlet port 5 side. The top of the steam box inner wall is higher than the dam 41. The exhaust box 42 is mounted so as to extend over both the side of the shell main body 1 and the steam box 7 The lower part of the exhaust box 42 is connected to the side of the shell main body. The upper portion of the exhaust box 42 is connected to the side of the steam box 7 and the interior of the exhaust box 42 communicates with the interior of the steam box 7.

The shape of the dam 41 is formed as a curved surface corresponding to the shape of the side of the shell main body i so as to divide the interior of the shell main body 1 and the exhaust box 42. Above the dam 41, an opening 43 is formed to communicate with the interior of each of the exhaust box 42 and the steam box 7. The dam 41 may be provided as an independent member of the shell main body 1 or the exhaust box 42 as shown as a solid line in FIG. 6, or may be provided as a part of the side of the shell main body 1 as shown as dashed line in FIG. 6.

Accordingly, when an absorbing solution is injected from absorbing solution injecting port 3, it is exhausted over dam 41 to the absorbing solution exhausting port 4 which is on the shell main body 1 at the heat source inlet port side. The inner wall top of the exhausting port 4 is lower than top of dam 41, and the lower part of the exhaust box 42 is filled with the absorbing solution. The steam box 7 at the absorbing solution exhausting port 4 side, whose inner wall opening 43 is higher than dam 41, is not filled with the absorbing solution. The space between the inner wall opening 43 and dam 41 which is not filled with the absorbing solution is a region where refrigerant vapor is generated. Consequently, the absorbing solution injecting port 3 side (heat source outlet port 6 side) is a closed type heat exchanger, and the absorbing solution exhausting port 4 side (heat source inlet port 5 side) is an open type heat exchanger.

Baffles 9 are provided in a zigzag pattern so that the absorbing solution flows, meandering from absorbing solution injection port 3 to absorbing solution exhausting port 4. In addition, the baffles 9 are attached so that the pitch, i.e., spacing of the baffles from each other, becomes larger from absorbing solution injecting port 3 to the absorbing solution exhausting port 4. Since the baffles 9 cause the absorbing solution to meander, for the purpose of putting the absorbing solution in even contact with heat transfer pipes 2, thereby to decrease temperature fluctuation, basically the effect becomes greater as the number of the attached baffles 9 increases. However, flow of the absorbing solution becomes difficult if too many baffles 9 are mounted at a small pitch where fluid is at low pressure. Thus, many baffles 9 are mounted at a small pitch (higher density spacing) in the closed type heat exchanger side having no escape for the injection pump pressure, whereas a smaller number of baffles 9 are mounted at a large pitch in the open type heat exchanger side having steam box 7 in which the pressure is opened and therefore lower.

If the absorbing solution is heated, for instance, to 127° C. and supplied into shell main body 1 from absorbing solution injecting port 3, the absorbing solution pressure is low as compared with the present inner pressure of 70 mmHg and saturation temperature of 154° C. of the generator, and thus it meanders through the inside of the closed type heat exchanger at the absorbing solution injecting port 3 side, heated by heat transfer pipes 2, for instance, to 146° C. through convective heat transfer. The absorbing fluid then begins subcool boiling to generate tiny bubbles on the surface of heat transfer pipes 2. The bubbles generated in the closed type heat exchanger gradually expand, but, from the conventional weak upward flow, they group up with a lateral flow as they approach steam box 7 at the absorbing solution exhausting port 4 side, because the pump pressure is acting on them.

The bubbles grow large since the passage is structurally long in the lateral direction, and they become a gas-liquid two-phase flow of forced convection. In addition, since this flow is very strong, its energy still remains even at the open type heat exchanger having steam box 7, and the lateral flow of bubbles is stronger than the traditional upward flow. Accordingly, the liquid side heat transfer coefficient of the open type heat exchanger, which is a region for boiling, greatly increases. Further, since absorbing solution injecting port 3 is provided at a position higher than dam 41, the absorbing solution of the generator can be prevented from flowing out to the absorbing solution pump when the absorbing solution pump stops. For this, the lack of the absorbing solution of the generator can be prevented to avoid crystallization.

Figure 3:
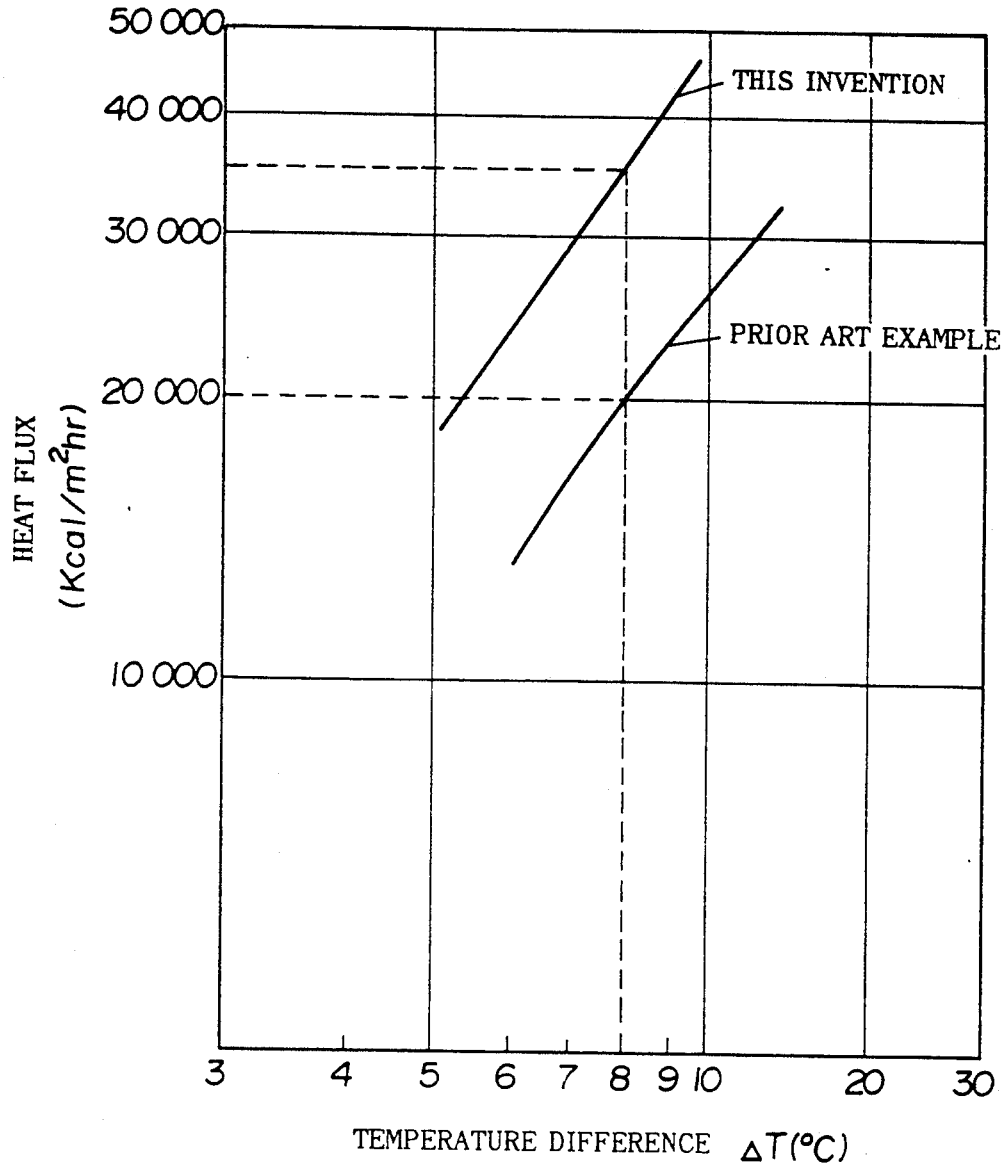
FIG. 3 is an explanatory view showing the effects.

In FIG. 3, an example of the performance of the generator according to this invention is shown comparatively with a conventional generator example. Temperature difference $\Delta T$ on the abscissa is the difference between the average temperature of the high temperature vapor passing in heat transfer pipes 2 and the average temperature of the absorbing solution in the generator, and the ordinate represents heat flux. As is obvious from this figure, by the generator of this invention, a heat flux larger than the conventional generator can be obtained at any temperature difference $\Delta T$. For instance, if they are compared when temperature difference $\Delta T$ is 8° C., a heat flux of 35000 Kcal/m$^2$hr can be obtained with the generator of this invention, whereas only a heat flux of 20000 Kcal/m$^2$hr can be obtained with the conventional generator, and thus it is seen that a heat flux 1.75 times the conventional generator can be obtained with this invention. In addition, the heat transfer characteristics do not degrade even at temperature difference $\Delta T$ not higher than 7° C.

As described above, the generator according to this invention has improved heat transfer characteristics over the conventional generator. According to comparison under the same condition, heat transfer characteristics 1.75 times the conventional generator have been obtained. In addition, even if the temperature difference between the temperature of the heat source supplied to heat transfer pipes and the temperature of the absorbing solution is only in the order of 5° to 6° C., the heat transfer characteristics are substantially the same as the conventional apparatus running at a temperature difference of 8° C. Further, because of being a closed type generator, the amount of the absorbing solution, such as lithium bromide, to be filled can greatly be reduced as compared with the conventional open type generator, so that cost reduction can be achieved. The apparatus also has large industrial merits from the point of excellent heat transfer characteristics, as well as the possibility of being made small-sized and lightweight.

What is claimed is:

1. A generator for an absorption refrigerator comprising:

a shell having a heat source fluid inflow side and a heat flow fluid outflow side, said shell containing heat transfer pipes for transmitting the heat source fluid within said shell, an exhaust port located on said shell for exhausting an absorbing solution at the heat source fluid inflow side, and an injection port for injecting the absorbing solution at the heat source fluid outflow side, said injected absorbing solution filling said shell at said injection port and over an extent of said shell to form a closed type heat exchanger, and first means being provided at said exhaust port and over an extent of said shell to provide an open space above the flowing absorbing solution and to form an open type heat exchanger.

2. The generator claimed in claim 1 further including a plurality of baffles in the shell main body, the baffles having a first pitch in the closed type heat exchanger and the baffles having a pitch greater than said first pitch in the open type heat exchanger.

3. The generator claimed in claim 1 wherein a dam separates the interior of said shell at the open type heat exchanger and said exhaust port, the absorbing solution injection port is provided at a position higher than the dam at the absorbing solution exhaust port of the open type heat exchanger.

4. The generator of claim 1 wherein said first means is located at said heat source inlet side.

5. The generator of claim 1 wherein said first means comprises a housing having a first portion with an opening communicating with an opening in said shell from which said absorbing fluid flows into said first portion, and a second housing portion communicating with said first portion providing a space into which said absorbing solution can vaporize.

6. The generator of claim 5 wherein said absorbing solution outlet port is located at said first portion of said housing.

7. The generator of claim 5 further comprising a dam between said main body shell and said first housing portion over which said absorbing solution flows to enter said first housing portion.

8. The generator of claim 7 wherein said absorbing solution outlet port is located at said first portion of said housing.

* * * * *